United States Patent [19]

Chiang

[11] Patent Number: 4,879,804

[45] Date of Patent: Nov. 14, 1989

[54] METHOD OF FABRICATING A COIL

[76] Inventor: C. Y. Chiang, No. 238-6, Shian Chuang Tze Yeong An, Hsin Wu, 32707 Tao Yuan, Taiwan

[21] Appl. No.: 252,069

[22] Filed: Sep. 30, 1988

[51] Int. Cl.[4] ..... H01F 41/00

[52] U.S. Cl. ..... 29/605; 29/602.1; 29/827; 336/96; 336/192; 336/198

[58] Field of Search ..... 29/602.1, 605, 827; 336/96, 192, 198

[56] References Cited

U.S. PATENT DOCUMENTS 3,737,995 6/1973 Utner ..... 29/605

4,149,135 4/1979 Roespel et al. ..... 29/605 X

*Primary Examiner*—Carl E. Hall

*Attorney, Agent, or Firm*—Morton J. Rosenberg; David I. Klein

[57] ABSTRACT

There is provided a method of fabricating a coil and in particular to one including the steps of forming a frame with two vertically disposed supporting legs, mounting an axial coil and notches on the supporting legs, cutting off the conducting wire from two ends of the ferrite core of the coil, joining the conducting wire to the two ends of the ferrite core, enclosing the combined coil and the supporting legs with resin, and bending the lower part of the supporting leg upwardly along the outer surface of the coil.

1 Claim, 4 Drawing Sheets

METHOD OF FABRICATING A COIL

BACKGROUND OF THE INVENTION

It has been found that some prior art coils on the market are connected to other component parts via a conducting wire extending longitudinally or radially therefrom. However, it is desired to have the coil connected compactly with other component parts and hence a coil fabricated by the method shown in FIG. 6 is developed to try to meet the need. As may be seen in the figure, the ferrite core 10 of the coil is provided with a recess 10*a* at both ends for receiving the flattened head 12*a* of the conducting wire 12. The coil wire 16 of the coil is soldered to the conducting wire or the ends of the ferrite core 10 (see FIG. 7) thereby forming a coil 18. However, such connection of the coil wire and the ferrite core will cause magnetic leakage and/or decrease in magnetic conductivity.

It is, therefore, an object of the present invention to provide a method of fabricating a coil which may obviate and mitigate the above-mentioned drawbacks.

SUMMARY OF THE INVENTION

This invention relates to an improved method of fabricating a coil.

It is the primary object of the present invention to provide a method of fabricating a coil which is easy to produce.

It is another object of the present invention to provide a method of fabricating a coil which is of high capacity.

It is still another object of the present invention to provide a method of fabricating a coil which will not have magnetic leakage.

It is still another object of the present invention to provide a method of fabricating a coil which will not decrease the magnetic conductivity.

It is still another object of the present invention to provide a method of fabricating a coil which is inexpensive to manufacture.

It is a further object of the present invention to provide a method of fabricating a coil which is fit for mass production.

Other objects and advantages and a fuller understanding of the present invention will become apparent when the following detailed description of the best mode contemplated for practicing the invention has been read in conjunction with the accompanying drawings wherein like numerals refer to like or similar parts and in which:

DETAILED DESCRIPTION OF THE PREFERRED EMBODIMENT

Before explaining the present invention in detail, it is to be understood that the invention is not limited in its application to the details of construction and arrangement of parts illustrated in the accompanying drawings, since the invention is capable of other embodiments and of being practiced or carried out in various ways. Also it is to be understood that the phraseology or terminology employed herein is for the purpose of description and not of limitation.

Figure 1:
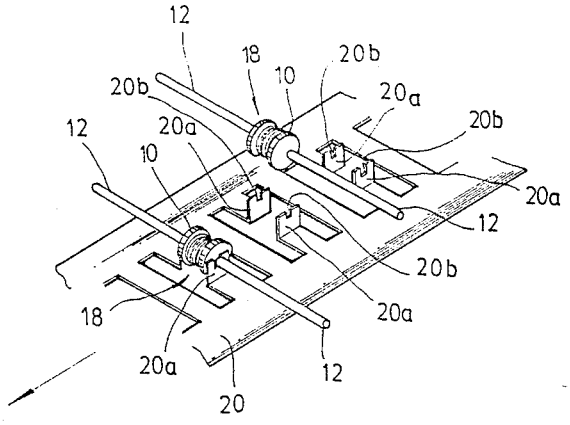
FIG. 1 shows the first step of fabricating a coil by the method according to the present invention.
Figure 2:
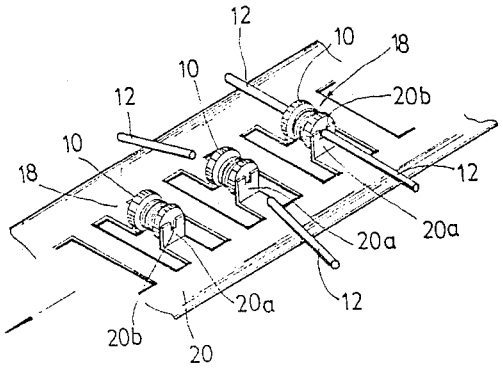
FIG. 2 shows the second step of fabricating the coil.
Figure 3:
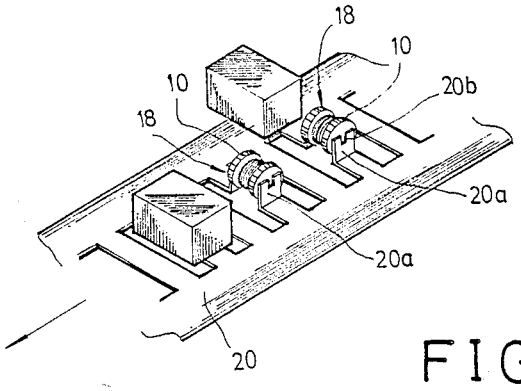
FIG. 3 shows the third step of fabricating the coil.
Figure 4:
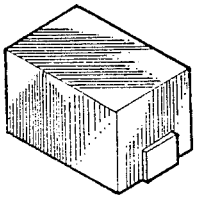
FIG. 4 is a perspective view of the coil fabricated by the method shown in FIGS. 1–3.
Figure 5:
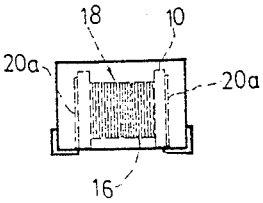
FIG. 5 is a front view showing the interior of the coil of FIG. 4.
Figure 6:
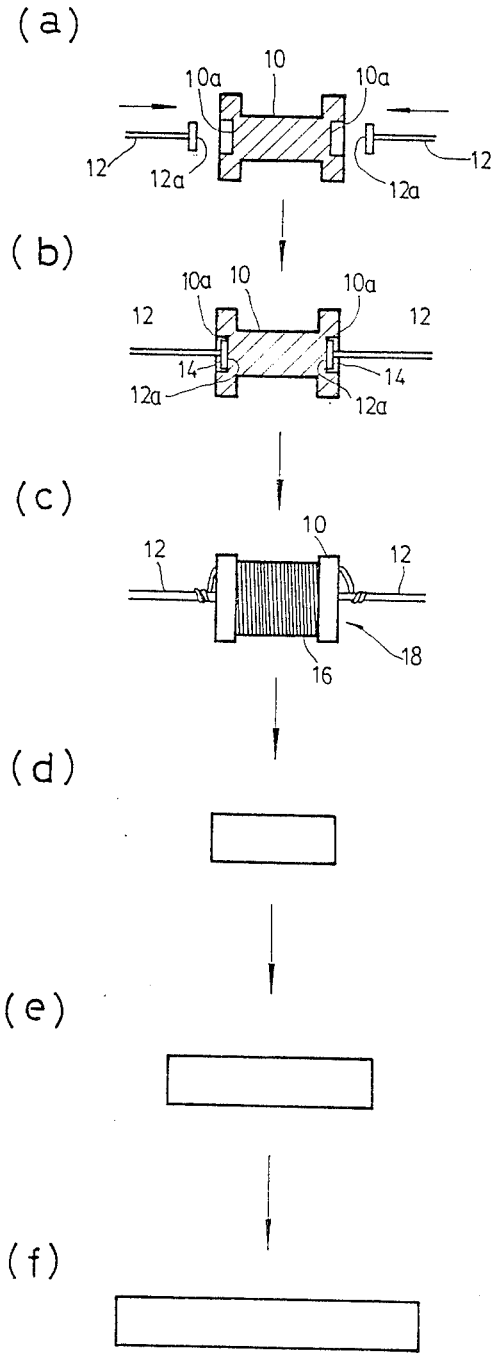
FIG. 6(a)–(*f*) shows the prior art fabricating process of a coil.
Figure 7:
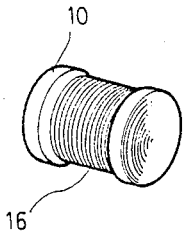
FIG. 7 shows the prior art coil.

Referring to the drawings and in particular to FIGS. 1–3 thereof, the method of fabricating an coil according to the present invention utilizes a frame 20 as the base. The frame 20 is made of sheet metal which is of high conductivity and easy to join with solder. A pair of supporting legs 20*a* are vertically formed on the frame 20 and provided with a notch 20*b* on the upper edge. The ferrite core 10 of a coil 18 is placed on the supporting legs 20*a*, with the conducting wire 12 received in the notches 20*b* of the the supporting legs 20*a*. Then, the conducting wire 12 is cut off from two ends of the coil 18 and joined to the ferrite core 10 of the coil 18 with solder. Thereafter, the combined coil 18 and the supporting legs 20*a* are enclosed with resin. Lastly, the lower parts of the supporting legs 20*a* are bent upwardly along the outer surface of the coil 18, forming two electrodes thereof.

It should be noted, however, that the coil 18 has the same structure as standard coils and so only minor changes are required to adapt to the production of the coil according to the present invention.

Furthermore, the coil fabricated by the present invention will have no magnetic leakage and will not decrease the magnetic conductivity.

From the forgoing description taken in connection with the accompanying drawings, it can be understood that the invention is not necessarily limited to the specific construction illustrated, but includes variants within the scope and spirit of the invention as defined by the claim.

I claim:

1. A method of fabricating a coil comprising the steps of:

forming a frame having a pair of opposingly displaced vertically disposed supporting legs each of said supporting legs having a notch formed within an upper portion thereof;

mounting an axial coil, said axial coil having a ferrite core and an electrically conducting wire extending along a center line of the ferrite core, said electrically conducting wire extending from opposing axial ends of said ferrite core between said supporting legs by placing said wire in said notches;

severing opposing ends of said conducting wire extending beyond said notches;

joining the conducting wire to said axial ends of the ferrite core;

encapsulating the combined supporting legs and the axial coil with resin thereby forming an enclosed structure; and, bending a lower part of each supporting leg upwardly along a respective outer surface of said structure thereby forming electrodes at the respective ends of the coil.

* * * * *